US006739262B2

(12) United States Patent
Böser et al.

(10) Patent No.: US 6,739,262 B2
(45) Date of Patent: May 25, 2004

(54) CLADDING FOR A PRINTING MACHINE

(75) Inventors: Diana Böser, Mannheim (DE); Werner König, Mannheim (DE); Rolf Kündgen, Eppelheim (DE); Burkhard Maass, Heidelberg (DE); Gerd Merkel, Dielheim (DE); Bernd Sitzmann, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 517 days.

(21) Appl. No.: 09/741,307

(22) Filed: Dec. 18, 2000

(65) Prior Publication Data

US 2001/0003956 A1 Jun. 21, 2001

(30) Foreign Application Priority Data

Dec. 17, 1999 (DE) ..... 299 22 154 U

(51) Int. Cl.[7] ..... B41L 41/00
(52) U.S. Cl. ..... 101/480; 101/479; 101/216
(58) Field of Search ..... 101/212, 216, 101/479, 480, 423, 425; 400/713, 691, 692, 693

(56) References Cited

U.S. PATENT DOCUMENTS 4,909,645 A * 3/1990 Sudo et al. ..... 400/120.16
4,961,659 A * 10/1990 Igarashi ..... 400/693
5,894,800 A 4/1999 Bär et al.
6,308,627 B1 * 10/2001 Konig et al. ..... 101/425
6,412,414 B1 * 7/2002 Loos ..... 101/425

FOREIGN PATENT DOCUMENTS

DE 19543518 A1 5/1997

* cited by examiner

*Primary Examiner*—Andrew H. Hirshfeld
*Assistant Examiner*—Kevin D. Williams
(74) *Attorney, Agent, or Firm*—Laurence A. Greenberg; Werner H. Stemer; Gregory L. Mayback

(57) ABSTRACT

A cladding of a printing machine in a region of a side wall of a printing unit of the printing machine includes a housing fastened to the side wall, the housing having an upper housing wall, two lateral housing walls and a housing cover connected to the lateral housing walls so as to be displaceable between a lower position covering the side wall and a position raised to a defined height.

5 Claims, 10 Drawing Sheets

CLADDING FOR A PRINTING MACHINE

BACKGROUND OF THE INVENTION

Field of the Invention

The invention relates to a cladding for a printing machine in a region of a side wall of the latter.

Cladding for a side wall of a printing machine serves primarily for protecting personnel from rotating and otherwise moving operating parts which project outwardly beyond the side wall and from parts which are located outside the side wall and are electrified. In addition thereto, however, there is also a requirement that an attendant should have access to the side wall. Such a situation occurs, for example, when, according to the published German Patent Document DE 195 43 518 A1, a supply reel and a take-up reel for a wash cloth of a device for washing printing unit cylinders have to be led, axially parallel thereto, through an orifice formed in the side wall.

In addition to this requirement, however, some demands are also made upon the construction of the cladding.

SUMMARY OF THE INVENTION

It is accordingly an object of the invention to provide a cladding for a printing machine in the region of a side wall of the latter, which is of such construction that, on the one hand, the protective function, and on the other hand, access to the side wall, can be assured.

With the foregoing and other objects in view, there is provided, in accordance with the invention, a cladding for a printing machine in a region of a side wall of a printing unit of the printing machine, comprising a housing fastened to the side wall, the housing having an upper housing wall, two lateral housing walls and a housing cover connected to the lateral housing walls so as to be displaceable between a lower position covering the side wall and a position raised to a defined height.

In accordance with another feature of the invention, the cladding includes an interlock which is prestressed into a locked position and by which, when the interlock is in the locked position, the housing cover is lockable in the lower position thereof.

In accordance with a further feature of the invention, the interlock is arranged at the housing cover, and the cladding includes an abutment provided on at least one of the lateral housing walls, the abutment, when in engagement with the interlock located in the locked position thereof, locks the housing cover in the lower position thereof.

In accordance with an added feature of the invention, the cladding includes a force accumulator arranged at the housing cover and prestressed in the lower position of the housing cover, the housing cover being displaceable by the force accumulator from the lower position of the housing cover into the raised position thereof.

In accordance with a concomitant feature of the invention, the force accumulator is carried by the housing cover, and the cladding includes stops formed on the lateral housing walls, the force accumulator being braceable against the stops.

Thus, the object of the invention is achieved by a housing fastened to the side wall, with an upper housing wall, with two lateral housing walls and with a housing cover which is connected to the lateral housing walls so as to be displaceable between a lower position covering the side wall and a position raised to a defined height.

A cladding constructed in this manner, with the housing cover raised, opens up access to precisely that part of the side wall which, as stated, must be accessible for manipulations on the device for washing printing unit cylinders and which is located in a lower portion of the side wall, while at the same time the entire side-wall region located above the lower portion is covered.

Other features which are considered as characteristic for the invention are set forth in the appended claims.

Although the invention is illustrated and described herein as embodied in a cladding for a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
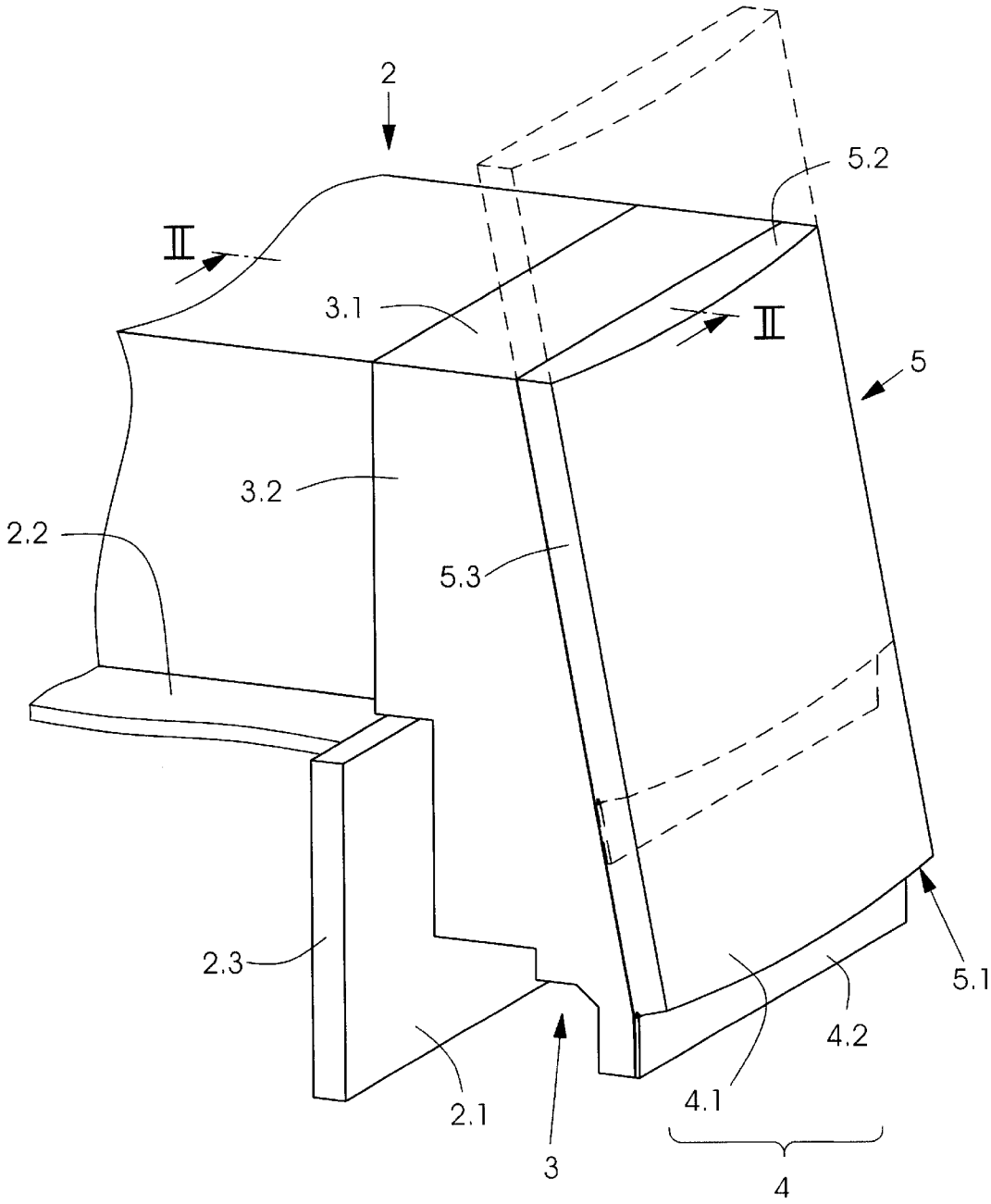
FIG. 1 is a front side and top perspective view of a cladding including a housing and a housing cover, in a first operating position of the housing cover reproduced by solid lines, and in a second operating position of the housing cover reproduced by broken lines.

Identical parts have like reference characters in all of the figures.

Referring now more specifically to the figures of the drawings, there is shown in FIG. 1 the outer contours of a cladding 1 which is assigned to a printing unit 2, only part of which is reproduced in outline. The printing unit 2 is carried by side walls 2.1, only one of which is illustrated, and is accessible by an attendant from a walk-on platform 2.2. The printing unit 2 is designed for an inline form of construction. For this purpose, the side walls 2.1, respectively, have assembly surfaces 2.3 for connection to a further printing unit.

The cladding 1 includes a housing 3 with an upper housing wall 3.1, two lateral housing walls 3.2 and a housing cover 4. For reasons of design, the end faces of the lateral housing walls 3.2 which face away from the printing unit 2 extend vertically in a lower region and at an inclination in an adjoining upper region, with the distance of the end faces from the side wall 2.1 decreasing constantly. To match this, the housing cover 4 includes a cover member 4.1, which extends along the inclined region of the end faces of the lateral housing walls 3.2 in the lower operating position illustrated by solid lines, wherein the side wall 2.1 is covered by the housing cover 4, and also a flap 4.2, which is articulatedly connected to the lower end of the cover member 4.1 pivotably about the non-illustrated horizontal axis, and which, in the operating position, abuts that region of the end faces of the lateral housing walls 3.2 which, respectively, extends vertically. Moreover, the cover 4.1 is constructed in the form of a trough 5 and so as to project or jut out relative to the flap 4.2. The trough 5 includes a lower trough end wall 5.1 adjoining the flap 4.2, an upper trough end wall 5.2 aligned with the upper housing wall 3.1, trough side walls 5.3 aligned with the lateral housing walls 3.2 and a trough bottom 5.4 which is directed away from the side wall 2.3 and both for reasons of construction and for reasons of stability extends, convexly curved, from one of the trough side walls 5.3 to the other.

The platform 2.2 can be reached via non-illustrated steps, in the vicinity of which the lateral housing walls 2.3 are notched out.

Figure 2:
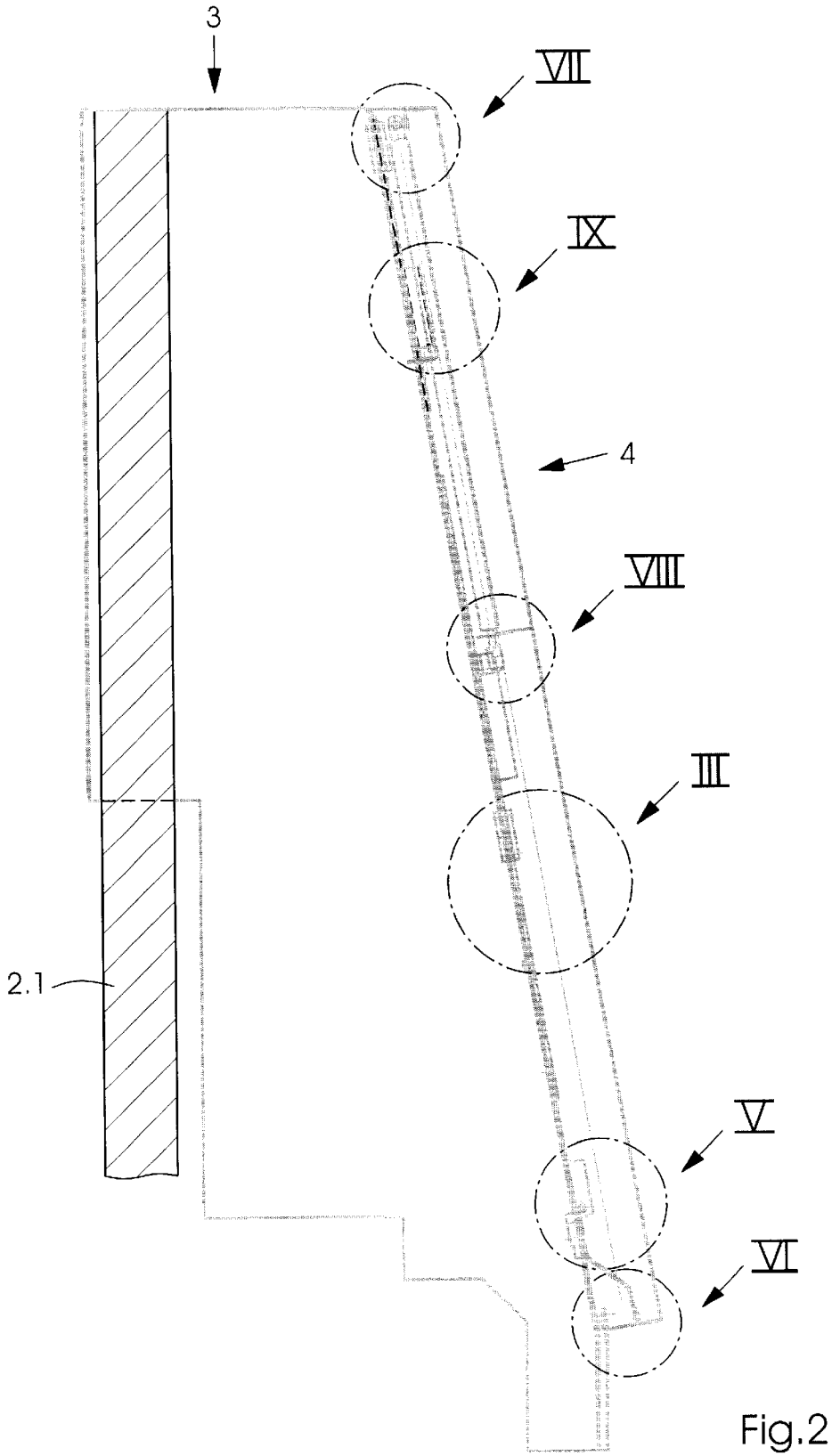
FIG. 2 is a vertical sectional view of FIG. 1 taken along the line II—II in the direction of the arrows.

The vertical section reproduced in FIG. 2, taken along the line II—II shown in FIG. 1 serves for explaining the details reproduced in FIGS. 3, 3*a* and 5 to 9.

Figure 3:
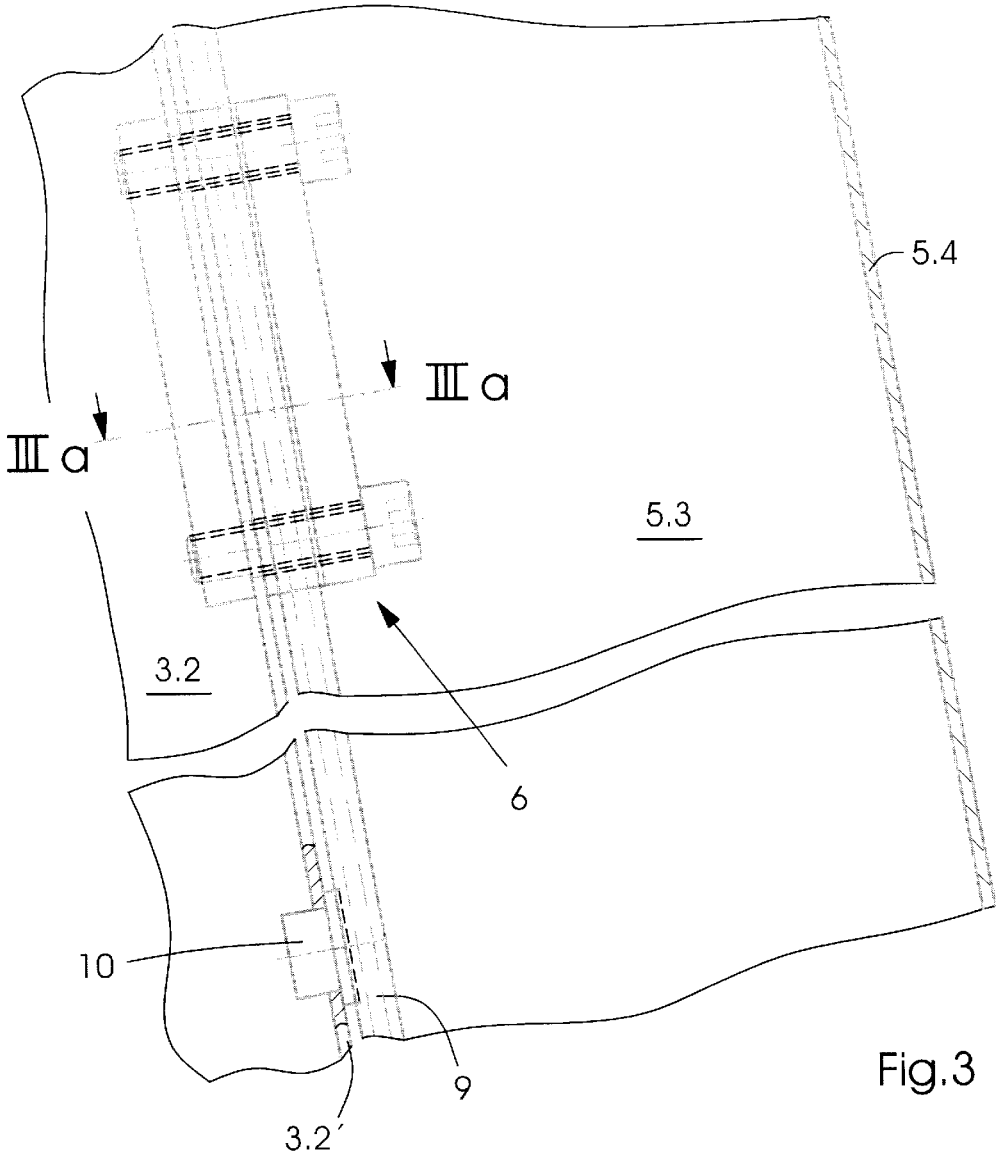
FIG. 3 is an enlarged fragmentary view of FIG. 2 showing the encircled detail identified as III therein.

In the illustrated exemplary embodiment, the housing 3, the flap 4.2 and the trough 5 are formed as sheet-metal structures. FIG. 3, illustrating the detail III shown in FIG. 2, and FIG. 3*a*, in the form of a section taken along the line IIIa—IIIa in FIG. 3, reveal a mechanism which is provided in an advantageous embodiment and which connects the housing cover 4 to the lateral housing walls 3.2 so that the housing cover 4 is displaceable between a lower operating position thereof and an upper operating position thereof. For the corresponding connection, the lateral housing walls 3.2 are provided, at the ends thereof facing away from the side wall 2.1, with folded portions 3.2' which face one another. Fastened to the outside so that these folded portions 3.2' at selected locations, respectively, (here, at the locations of the details III and VII in FIG. 2) is a guide profile 6 which here, is, for example, multipartite and which here, in conjunction with the folded portion 3.2', forms a guide groove 7 which, respectively, opens outward and is oriented in the direction of displacement of the housing cover 4. One of the trough side walls 5.3 is likewise provided, respectively, with folded portions 8 which face one another and which here, moreover, are turned around to form a rabbet 9. The respective rabbet 9 engages in the guide grooves 7 assigned thereto. In the illustrated exemplary embodiment, the guide groove 7 has a greater width than the thickness of the rabbet 9. This dimensional difference is bridged by guide bosses 10, preferably formed of a highly slidable plastic material, which are pressed into the folded portions 3.2' of the lateral housing walls 3.2. In order to introduce the rabbets 9 of one of the trough side walls 5.3, respectively, into the guide groove 7 assigned thereto, the rabbets 9 are notched locally, as can be seen in FIG. 4, specifically in such a way that, in a mounting position above a raised position which can be assumed during operation, the trough 5 is capable of abutting the guide bosses 10, without being impeded by the guide profiles 6. The trough 5 is thus slipped into the guide grooves 7 in the manner of a bayonet lock or fastening.

Figure 5:
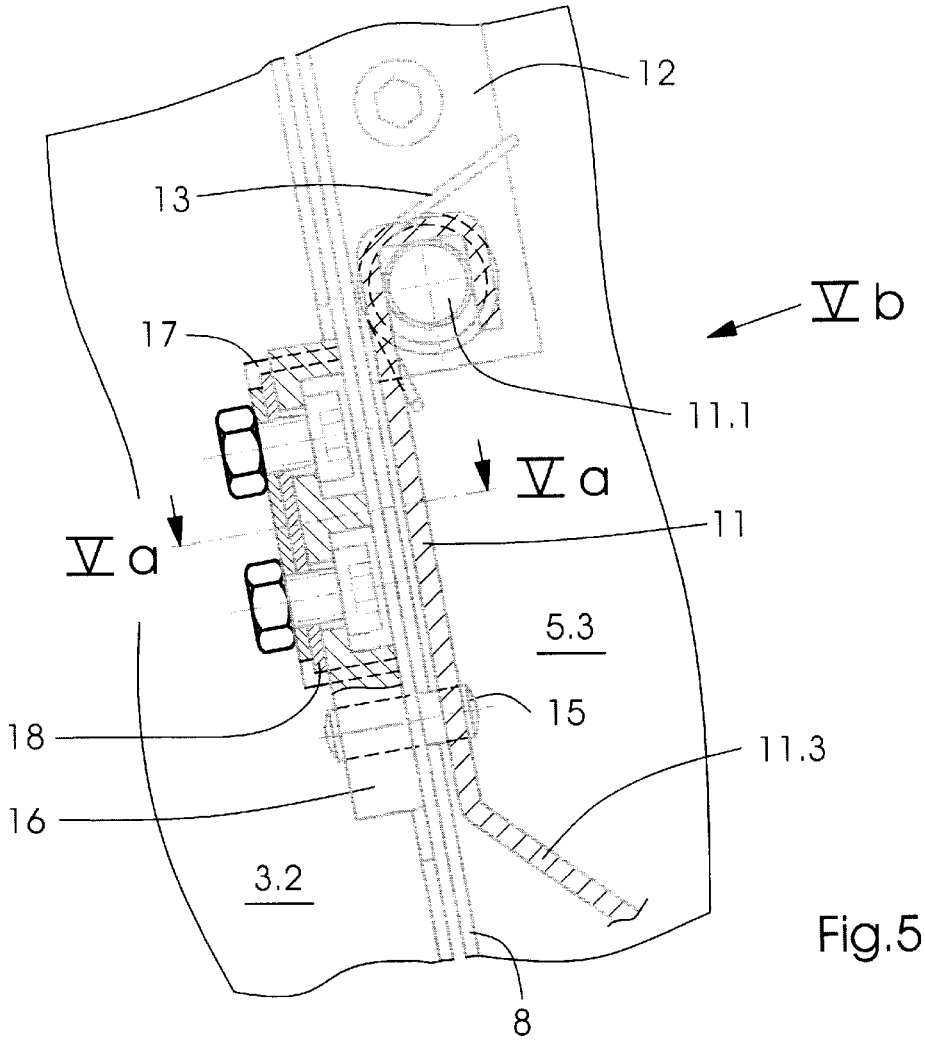
FIG. 5 is an enlarged fragmentary view of FIG. 2 showing the encircled detail identified as V therein.
Figure 5A:
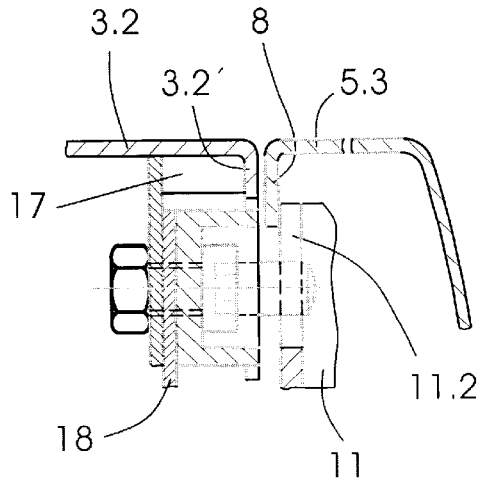
FIG. 5*a* is a cross-sectional view of FIG. 5 taken along the line Va—Va in the direction of the arrows.
Figure 5B:
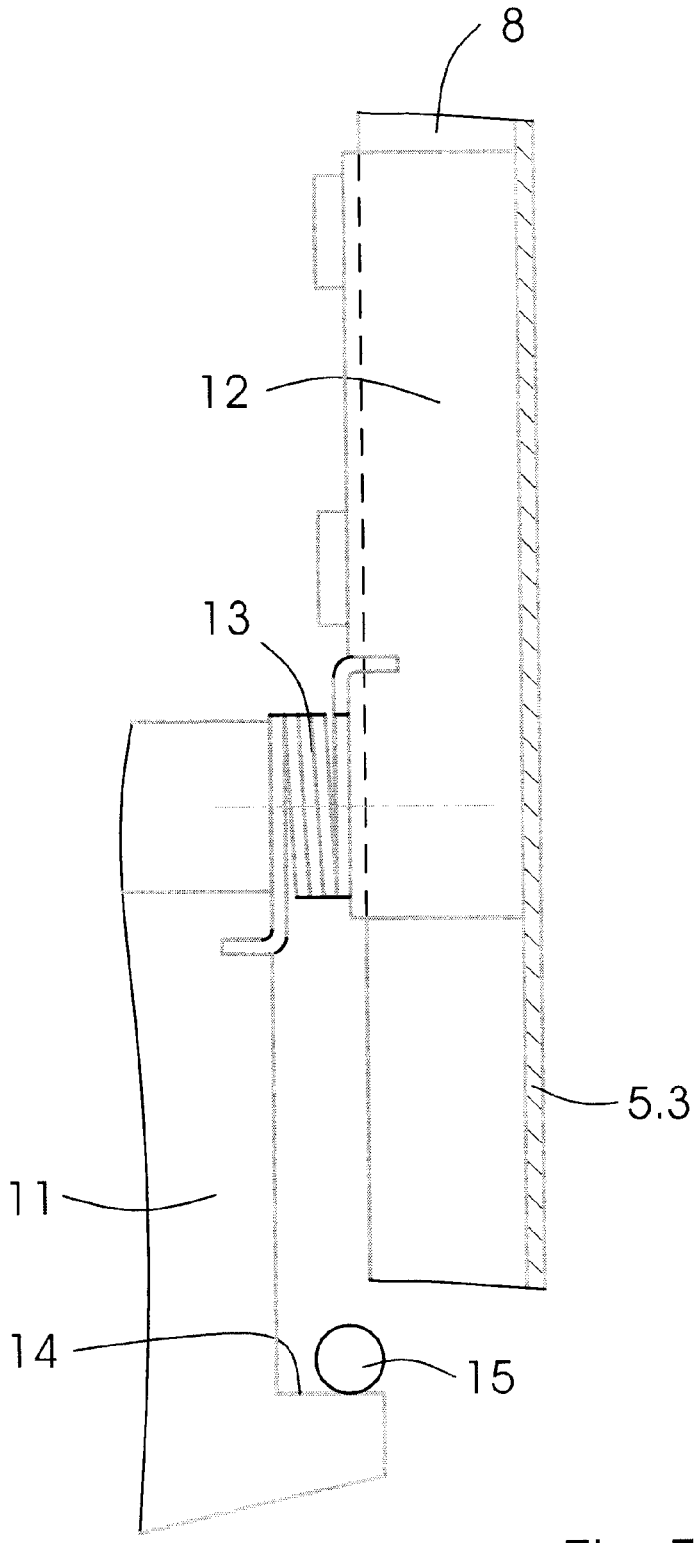
FIG. 5*b* is a view of FIG. 5 as seen in the direction of the arrow 5*b;*

FIG. 5 illustrating the detail V of FIG. 2, the sectional view of FIG. 5*a* taken along the line Va—Va in FIG. 5, and the FIG. 5*b* as viewed in the direction of the arrow Vb in FIG. 5, reveal a mechanism which is provided in an advantageous embodiment and by which the housing cover 4 is lockable in the lower position thereof, specifically counter to the action of a force accumulator, as explained hereinafter, which exerts an upwardly directed actuating force on the housing cover 4. This mechanism preferably includes an interlock or latch 11 prestressed into a closed or locked position. The interlock 11 extends between the trough side walls 5.3. At an upper end of the interlock 11, the latter is connected to pins 11.1 which project beyond the lateral extent thereof and are aligned with one of the trough side walls 5.3, respectively, and are received concentrically in two bearing blocks 12, one of which is fastened, respectively, to one of the trough side walls 5.3. The axes of the pins 11.1 form a horizontal pivot axis of the interlock 11. In FIG. 5, the interlock 11 is pivoted into a closing position with respect to this pivot axis. A spring 13 formed as a coiled flexural spring surrounding the pivot axis of the interlock 11, is supported with one of the spring legs thereof on the bearing block 12 and with the other spring leg thereof on a side of the interlock 11 directed into the interior of the trough 5, and simultaneously exerts an actuating force on the interlock 11, under which the latter remains in the closed or locked position thereof in bearing contact on the folded portion 8 of the trough side wall 5.3. In this closed position, a stop face 11.2 of the interlock 11 engages under an abutment 15 in the form of a detent or locking bolt, which projects out of a mounting 16 which is inserted in a notched part of a folded portion 3.2' of the lateral housing walls 3.2, respectively, and is screwed to a bent sheet-metal part 17 fastened to the folded portion, with a crosspiece being interposed, the latter extending between the two lateral housing walls 3.2 and bracing them.

Figure 6:
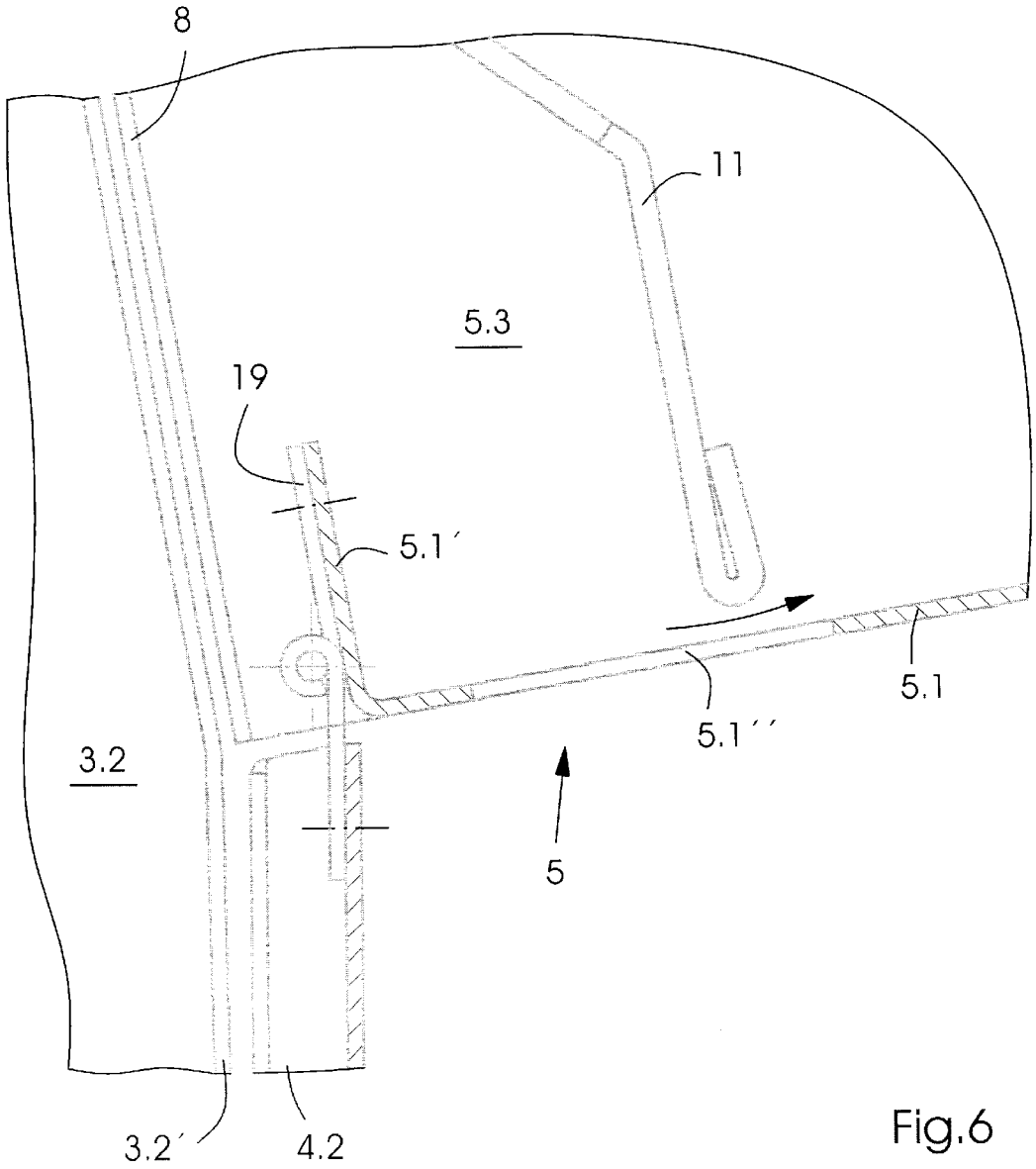
FIG. 6 is an enlarged fragmentary view of FIG. 2 showing the encircled detail identified by VI therein.

FIG. 6 which reproduces, in an enlarged view, the detail VI of FIG. 2, reveals the aforementioned horizontal axis, about which the flap 4.2 is pivotable. This axis is formed by an articulating joint or hinge 19. The latter is fastened, on the one hand, to the flap 4.2 and, on the other hand, to a folded portion 5.1' projecting into the interior of the trough 5. This connection of the flap 4.2 to the trough 5 makes it possible for the flap 4.2 to follow the inclined folded portion 3.2' of the lateral housing walls 3.2 when the housing cover 4 is raised.

Furthermore, FIG. 6 reveals a notch 5.1" formed in the lower trough end wall 5.1, the interlock 11 being accessible through the notch. Actuation of the interlock 11 in the direction of the arrow indicated counter to the action of the spring 13 (note FIGS. 5 and 5*b*) moves the interlock 11 out of the closed position thereof illustrated in FIGS. 5 and 5*a*. Actuation in the indicated direction takes place either manually by engagement into the notch 5.1", specifically in order to raise the housing 4, or automatically when the latter is lowered from the raised position thereof into the lower position thereof. For this automatic actuation, the interlock 11 has a portion 11.3 provided thereon which is angled-away in such a manner that the latter, sliding along on the abutment 15 constructed here as a detent bolt, is initially moved out of the closed position thereof and assumes this position again the instant the stop face 11.2 of the interlock 11 engages under the abutment 15 (note FIG. 5).

Figure 3A:
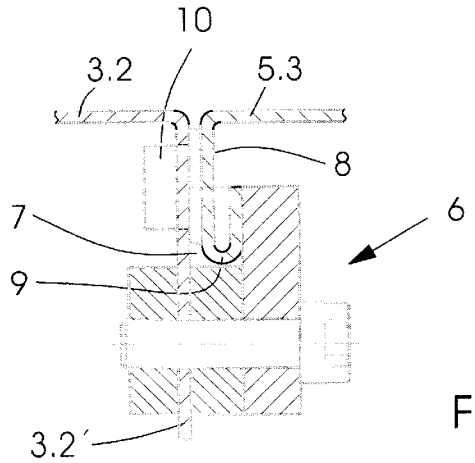
FIG. 3*a* is a fragmentary cross-sectional view of FIG. 3 taken along the line IIIa—IIIa in the direction of the arrows.
Figure 4:
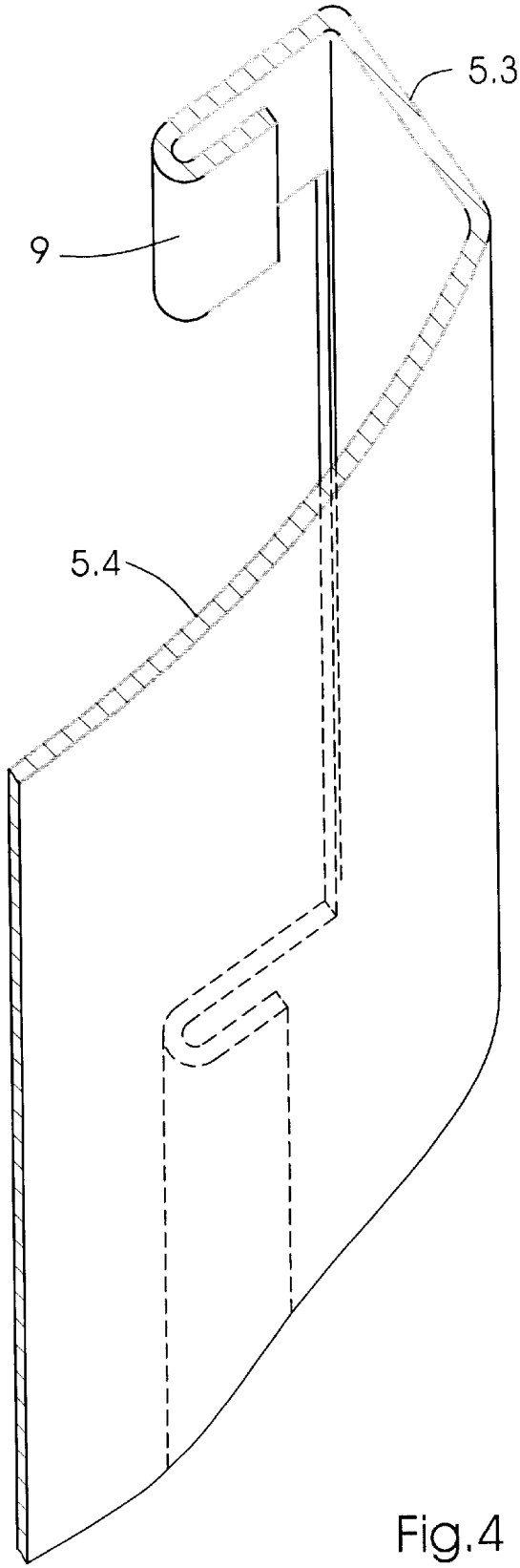
FIG. 4 is a perspective view of a detail of the housing cover.
Figure 7:
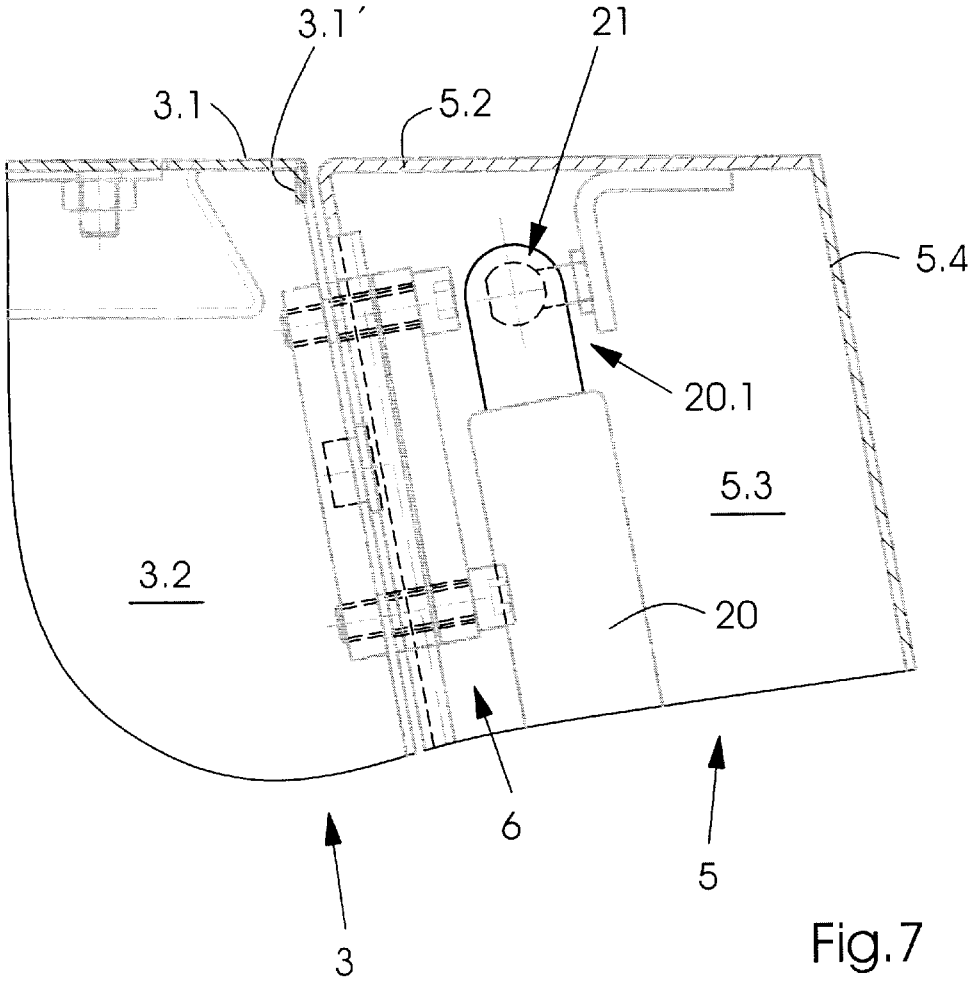
FIG. 7 is an enlarged fragmentary view of FIG. 2 showing the encircled detail identified by VII therein.

FIG. 7, which reproduces, in an enlarged view, the detail VII of FIG. 2, reveals, in addition to a further guide profile 6 for the displaceable connection of the vertically adjustable housing cover 4 to the housing 3, the guide profile 6 having already being described with regard to FIGS. 3 and 3*a*, an aforementioned force accumulator 20 by which the housing cover 4 can be displaced from the lower position thereof into the raised position thereof. A gas-pressure spring serves as force accumulator in this exemplary embodiment. The gas-pressure spring is arranged inside the trough 5, in such a way that a first end 20.1 of the force accumulator 20, illustrated by the gas-pressure spring, is fastened to the inside of the upper trough end wall 5.2 via an articulated connection 21.

Figure 8:
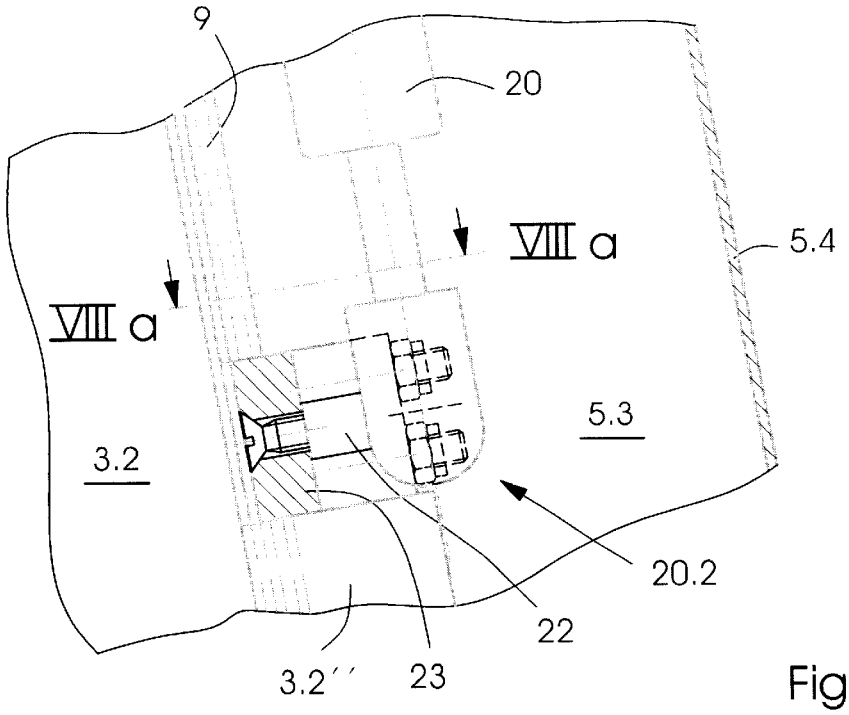
FIG. 8 is an enlarged fragmentary view of FIG. 2 showing the encircled detail identified by VIII therein.
Figure 8A:
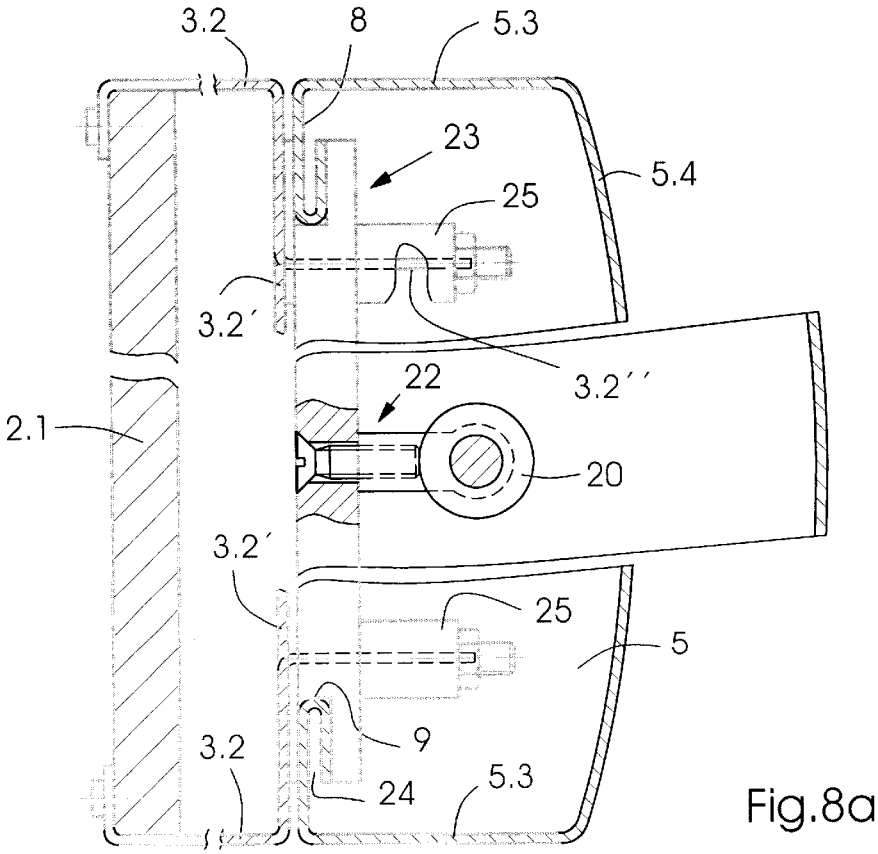
FIG. 8*a* is a cross-sectional view of FIG. 8 taken along the line VIIIa—VIIIa in the direction of the arrows.

FIG. 8, which reproduces, in an enlarged view, the detail VIII of FIG. 2, reveals the other end 20.2 of the force accumulator 20 provided here in the form of a gas-pressure spring. The force accumulator 20 is connected at this second end 20.2 to a crosspiece 23 via a further articulated connection 22, as indicated in FIG. 8*a* (corresponding to the section taken along the line VIIIa—VIIIa in FIG. 8). This crosspiece 23 extends between the trough side walls 5.3. Formed at a respective crosspiece end is a guide groove 24, into which one of the rabbets 9, respectively, engages. Fastened to the crosspiece 23 in an end portion of the latter, respectively, is a stop block 25 which projects into the interior of the trough 5. One of the stop blocks 25, respectively, is supported on a further folded portion 3.2", respectively, of the lateral housing walls 3.2, the folded portion 3.2" likewise projecting into the interior of the trough 5 and, respectively, forming a stop. These further folded portions 3.2" and the stop blocks 25 are dimensioned so that supporting forces, transmitted to the housing 3 by the crosspiece 23 via these further folded portions 3.2" and resulting from the prestress of the force accumulator 20, and the prestressing force taking effect in the force accumulator 20 generate as low a tilting moment as possible. Preferably, the dimensioning provided is such that the prestressing force takes effect in that plane which is spanned by the supporting forces.

After the interlock 11 has been moved out of the closed position thereof, which can be seen in FIG. 5, the force accumulator 20, provided as mentioned, displaces the housing cover 4 out of the lower position thereof into the raised position thereof.

Figure 9:
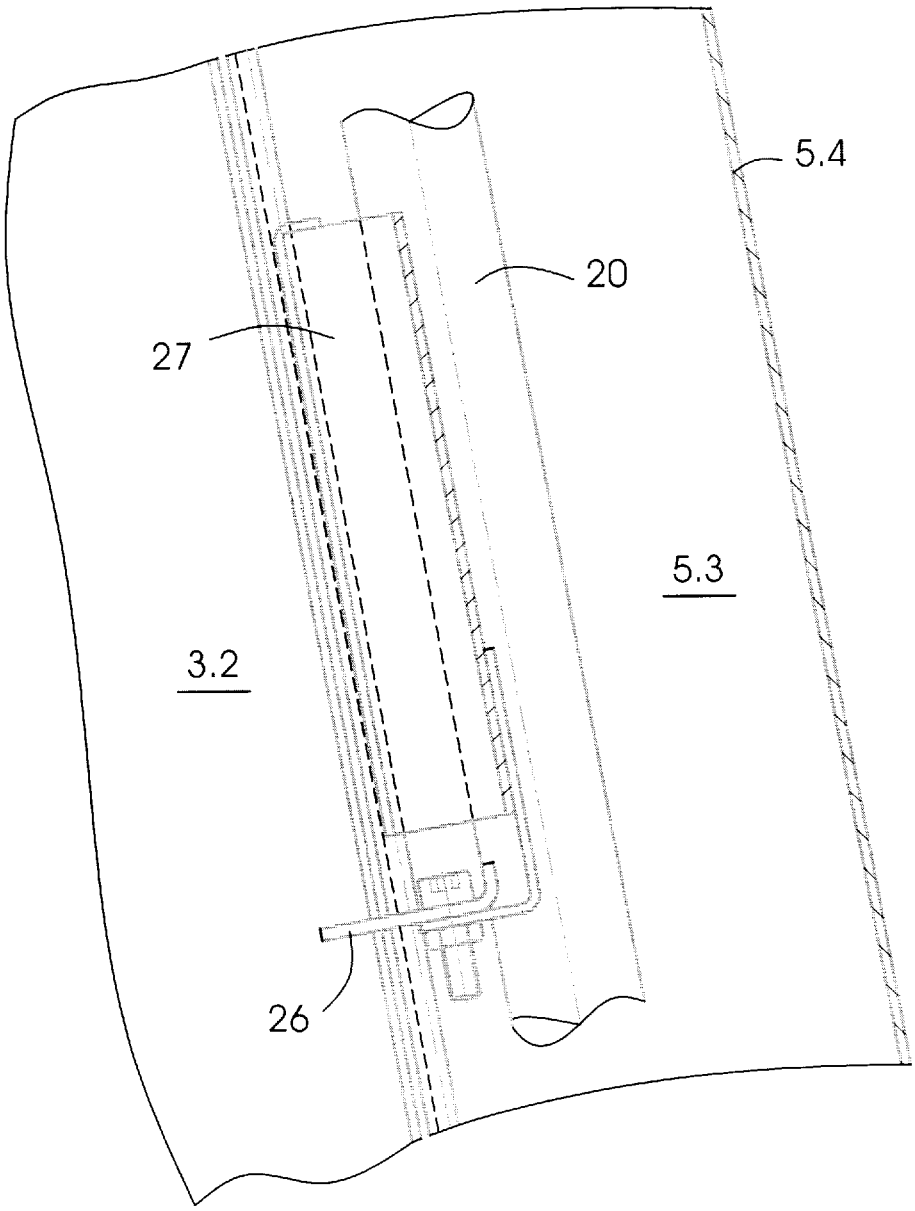
FIG. 9 is an enlarged fragmentary view of FIG. 2 showing the encircled detail identified by IX therein.

FIG. 9, which illustrates, in an enlarged view, the detail IX of FIG. 2, reveals a stop 26 which determines the height at which the housing cover 4 is located when it is in the raised position thereof. With the housing cover 4 in the raised position thereof, this stop 26 comes to bear on a folded portion 3.1', seen in FIG. 7, of the upper housing wall 3.1 and is connected (releasably, using a tool) to a strut 27 stiffening the trough 5. After the stop 26 has been released, the housing cover 4 can be raised to a height at which the aforedescribed connection thereof to the lateral housing walls 3.2, that connection being in the manner of a bayonet lock or fastening, can be released via the notches formed in the rabbets 9, as seen in FIG. 4.

The connection of the housing cover 4 in the manner of a bayonet lock or fastening to the folded portions 3.2' of the lateral housing walls 3.2, the accommodation of the abutment 15, serving for detaining the housing cover 4 in the lower position thereof, in the region of these folded portions, and the arrangement of the interlock 11 and of the force accumulator 20 inside the trough 5 afford the further advantage that, after the housing cover 4 has been disassembled from the housing 3, the latter is accessible, unimpeded, over the entire region between the folded portions 3.2' of the lateral housing walls 3.2 thereof. Moreover, the operating parts of the detaining or detent mechanism, which are arranged on the housing cover 4, and the opening mechanism including the force accumulator 20 are concealed inside the trough 5 and therefore have no influence on the external construction of the cladding. Furthermore, the raising of the housing cover 4 takes place automatically. There is advantageously no need for a tool in order to trigger the raising operation.

We claim:

1. A printing unit of a press comprising: a cladding in a region of a side wall of the printing unit, said cladding including a housing fastened to the side wall, the housing having an upper housing wall, two lateral housing walls, a housing cover connected to said lateral housing walls, and slide guides for guiding a movement of said housing cover, said housing cover being linearly displaceable between a lower position covering the side wall for preventing access to said side wall, and a position raised to a defined height for permitting access to at least a portion of said side wall.

2. The cladding according to claim 1, including an interlock prestressed into a locked position, said housing cover being lockable in said lower position thereof upon said interlock being in said locked position.

3. The cladding according to claim 2, wherein said interlock is arranged at said housing cover, and including an abutment provided on at least one of said lateral housing walls, said abutment, when in engagement with the interlock located in the locked position thereof, locks said housing cover in said lower position thereof.

4. The cladding according to claim 1, including a force accumulator arranged at said housing cover and prestressed in said lower position of said housing cover, said housing cover being displaceable by said force accumulator from said lower position of said housing cover into said raised position thereof.

5. The cladding according to claim 4, wherein said force accumulator is carried by said housing cover, and including stops formed on said lateral housing walls, said force accumulator being braceable against said stops.

* * * * *